US006707244B2

(12) United States Patent
Kimiya et al.

(10) Patent No.: US 6,707,244 B2
(45) Date of Patent: Mar. 16, 2004

(54) CATHODE-RAY TUBE APPARATUS

(75) Inventors: Junichi Kimiya, Kumagaya (JP); Hiroyuki Oda, Fukaya (JP); Takahiro Hasegawa, Gyoda (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 79 days.

(21) Appl. No.: 10/155,087

(22) Filed: May 28, 2002

(65) Prior Publication Data

US 2002/0175612 A1 Nov. 28, 2002

(30) Foreign Application Priority Data

May 28, 2001 (JP) ..... 2001-158810
May 23, 2002 (JP) ..... 2002-149517

(51) Int. Cl.[7] ..... H01J 29/50
(52) U.S. Cl. ..... 313/414; 313/269

(58) Field of Search ..... 313/414, 417, 313/269

(56) References Cited

U.S. PATENT DOCUMENTS 4,032,811 A * 6/1977 Schwartz et al. ..... 313/412

FOREIGN PATENT DOCUMENTS

JP 3-93135 4/1991
JP 3-95835 4/1991

* cited by examiner

*Primary Examiner*—Vip Patel
(74) *Attorney, Agent, or Firm*—Oblon, Spivak, McClelland, Maier & Neustadt, P.C.

(57) ABSTRACT

A dynamic focus electrode has a vibration-damping portion formed by a beading process at a peripheral portion of an electron beam passage hole thereof, a plate face thereof, or an embedment portion thereof. Thereby, vibration of the dynamic focus electrode is suppressed.

8 Claims, 8 Drawing Sheets

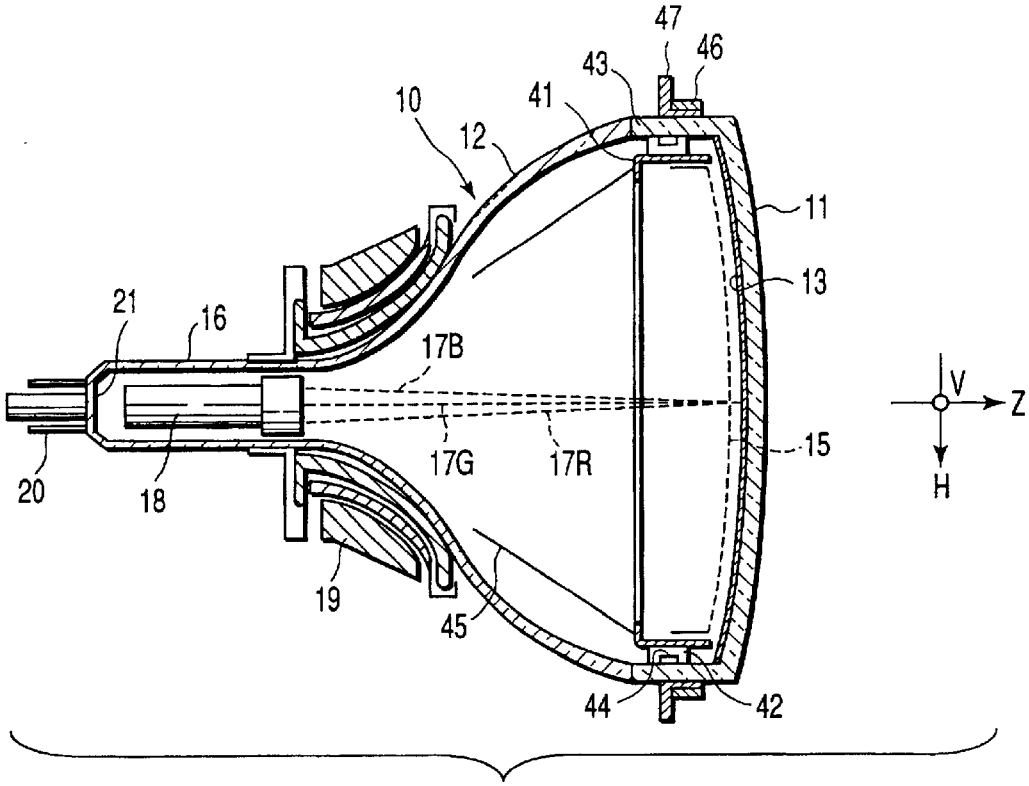
FIG. 10
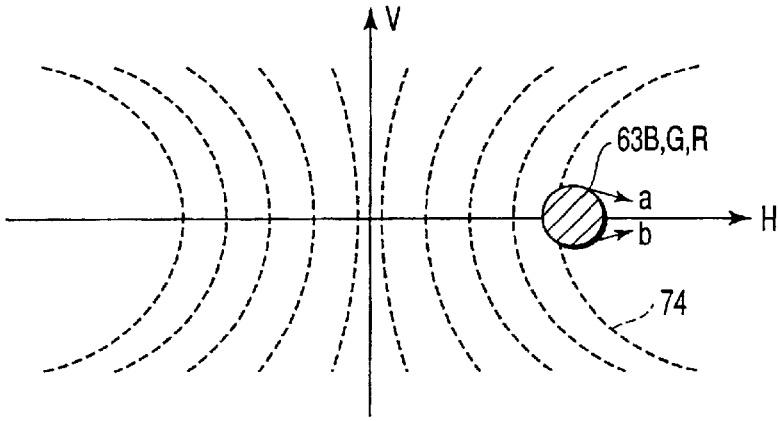
FIG. 11
FIG. 12
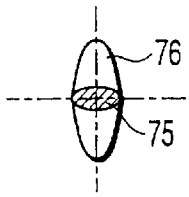

CATHODE-RAY TUBE APPARATUS

CROSS-REFERENCE TO RELATED APPLICATIONS

This application is based upon and claims the benefit of priority from the prior Japanese Patent Applications No. 2001-158810, filed May 28, 2001; and No. 2002-149517, filed May 23, 2002, the entire contents of both of which are incorporated herein by reference.

BACKGROUND OF THE INVENTION

1. Field of the Invention

The present invention relates generally to a cathode-ray tube (CRT) apparatus, and more particularly to a CRT apparatus having an electron gun assembly capable of effecting dynamic astigmatism compensation.

2. Description of the Related Art

In general terms, a color CRT apparatus comprises an in-line electron gun assembly that emits three electron beams, and a deflection yoke that produces deflection magnetic fields for deflecting the three electron beams emitted from the electron gun assembly and causing them to horizontally and vertically scan the phosphor screen. The deflection yoke produces non-uniform magnetic fields comprising a pincushion-shaped horizontal deflection magnetic field 74, as shown in FIG. 11, and a barrel-shaped vertical deflection magnetic field.

An electron beam 63 (B, G, R) that has passed through the non-uniform magnetic fields suffers a deflection aberration, i.e. astigmatism due to the deflection magnetic fields. Specifically, the electron beam 63 traveling to a peripheral portion of the phosphor screen suffers a force as indicated by arrows a and b by the deflection magnetic field 74. Consequently, as shown in FIG. 12, the beam spot on the peripheral portion of the phosphor screen deforms to have a vertically elongated low-luminance halo portion 76 and a horizontally elongated high-luminance core portion 75. Such deformation of the beam spot occurs at peripheral portions of the screen in the vertical direction V, horizontal direction H and diagonal direction D, as shown in FIG. 13. The deformation considerably degrades the resolution.

In order to improve the degradation in resolution, an electron gun assembly has been proposed, for example, in Jpn. Pat. Appln. KOKAI Publication No. 3-93135 and Jpn. Pat. Appln. KOKAI Publication No. 3-95835. In the proposed electron gun assembly, as shown in FIG. 14, a fourth grid G4 and a sixth grid G6 are supplied with a dynamic focus voltage obtained by superimposing an AC component E4 varying in synchronism with the deflection magnetic fields upon a DC voltage E3. Thereby, a first quadrupole lens is created between the third G3 and fourth grid G4, and a second quadrupole lens is created between the fifth grid G5 and sixth grid G6.

In this electron gun assembly, the first quadrupole lens corrects image-magnifications which differ in horizontal and vertical directions. At the same time, the second quadrupole lens and an ultimate focusing lens, which is created between the sixth grid G6 and seventh grid G7, function to prevent the electron beam 63, which is ultimately deflected onto the peripheral portion of the screen, from being extremely deformed by the deflection aberration due to the deflection magnetic fields.

With the deflection of the electron beams, potential differences vary between the fourth grid G4 and sixth grid G6 supplied with the dynamic focus voltage, on the one hand, and the adjacent third grid G3, fifth grid G5 and seventh grid G7, on the other. Accordingly, the coulomb force varies between the grids G3 through G7. Owing to the variation in coulomb force, mechanical vibrations occur in the grids G3 through G7. The mechanical vibrations are transmitted to the funnel via insulating supports, which support the grids G3 to G7, and stem pins electrically connected to the grids G3 to G7. Consequently, the funnel vibrates, and abnormal noise is produced from the funnel.

The third grid G3 is a main factor that increases the amplitude of vibration of the funnel. The first reason is that the distance between the third grid G3 and fourth grid G4 is narrower than that between the third grid G3 and second grid G2. Thus, the variation in coulomb force between the third grid G3 and fourth grid G4 is greater than that between the second grid G2 and third grid G3, and vibration easily occurs between the third grid G3 and fourth grid G4. The second reason is that the third grid G3 is formed of a plate-shaped electrode. Therefore, compared to a cup-shaped electrode body such as the fifth grid G5 that extends in the tube-axis direction, the third grid G3 has a lower flexure rigidity to vibration in the tube-axis direction and tends to vibrate easily.

More specifically, the third grid G3 is a plate-shaped electrode and is supported and fixed by insulating supports at its upper and lower portions. The coulomb force acting between the electrodes is mainly applied to an intermediate portion between the two support points at the upper and lower portions of the third grid G3 when the third grid G3 is supported at these two points. Consequently, as shown in FIG. 16, the third grid G3 flexes in the tube-axis direction and vibrates.

The vibration occurring at the third grid G3 and fourth grid G4 is modulated while being transmitted to the funnel. The vibration is frequency-modulated or increased by a resonance phenomenon due to the frequency of the dynamic focus voltage and the natural vibration characteristics of the third grid G3 and fourth grid G4 in the tube-axis direction. Consequently, the funnel vibrates at audio frequencies (20 Hz to 20 kHz) and produces abnormal noise. The natural vibration characteristics, that is, the characteristic frequency, are determined by the distance between the paired insulating supports that fix the electrode, the thickness of the electrode, the hardness of the electrode material, the electrode structure, etc.

In particular, when such a high-frequency voltage as to vary in synchronism with the horizontal deflection magnetic field is applied as the dynamic focus electrode, abnormal noise at a higher level may be produced due to resonance. Moreover, it has been made clear by experiments that the abnormal noise increases as the fourth grid G4 and sixth grid G6 supplied with the dynamic focus voltage are disposed closer to the cathodes K (on the stem section side) accommodating heaters.

The reasons appear to be that (1) the stem pins are firmly fixed to the stem section by means of welding, and so vibration occurring in each grid may easily be transmitted, (2) the electrode supplied with the dynamic focus voltage is formed of a plate-shaped electrode, and so it may easily transmit the vibration, and (3) the electrode supplied with the dynamic focus voltage is disposed near the heaters, and thus it may easily thermally expand. It is assumed that these factors may be combined in a complex fashion and a large abnormal noise is produced.

A dynamic focus voltage including an AC component E4 of 40 kHz to 100 kHz was applied to the fourth grid G4 and sixth grid G6 of the CRT apparatus with the electron gun assembly 64 shown in FIG. 14. The level of produced abnormal noise was measured. FIG. 15 shows the measured results.

In FIG. 15, the abscissa indicates the frequency of the AC component E4 included in the dynamic focus voltage, and the ordinate indicates the level of sound pressure sensed by humans in 10 grades. Normally, the level of abnormal noise needs to be suppressed to level 2 or less, at which the noise is hardly sensed by humans or negligible as being not unpleasant. According to the measured results shown in FIG. 15, the noise level exceeds level 2 at many frequency bands. If abnormal noise of level 2 or more has occurred, even if good image characteristics are obtained by the application of the dynamic focus voltage, the viewer feels unpleasant, and the product value and reliability of the CRT apparatus are greatly degraded.

BRIEF SUMMARY OF THE INVENTION

The present invention has been made in consideration of the above problems, and its object is to provide a cathode-ray tube apparatus which can suppress abnormal noise and has a high product value and reliability.

According to an aspect of the invention, there is provided a cathode-ray tube apparatus comprising: a substantially rectangular face panel; a funnel made continuous with the face panel; a phosphor screen formed on an inner surface of the face panel; an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage; a deflection yoke which produces deflection magnetic fields that horizontally and vertically deflect the electron beams emitted from the electron gun assembly; an insulating support which extends in a tube-axis direction and supports and fixes the plurality of electrodes of the electron gun assembly; and a plurality of stem pins provided at one end of the neck and electrically connected to the electrodes of the electron gun assembly, wherein the dynamic focus voltage is a voltage obtained by superimposing an AC component varying in synchronism with the deflection magnetic fields upon a reference voltage, the dynamic focus electrode comprises embedment portions to be embedded in the insulating support, electron beam passage holes that pass the electron beams through, and a vibration-damping portion formed in the surface including the electron beam passage holes to suppress vibration in the tube-axis direction, and the vibration-damping portion is formed of a recessed/projected portion recessed or projected in the tube-axis direction.

According to another aspect of the invention, there is provided a cathode-ray tube apparatus comprising: a substantially rectangular face panel; a funnel made continuous with the face panel; a phosphor screen formed on an inner surface of the face panel; an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage; a deflection yoke which produces deflection magnetic fields that horizontally and vertically deflect the electron beams emitted from the electron gun assembly; an insulating support which extends in a tube-axis direction and supports and fixes the plurality of electrodes of the electron gun assembly; and a plurality of stem pins provided at one end of the neck and electrically connected to the electrodes of the electron gun assembly, wherein the dynamic focus voltage is a voltage obtained by superimposing an AC component varying in synchronism with the deflection magnetic fields upon a reference voltage, at least one of the electrodes, which is adjacent to the dynamic focus electrode, comprises embedment portions to be embedded in the insulating support, electron beam passage holes that pass the electron beams through, and a vibration-damping portion formed in the surface including the electron beam passage holes to suppress vibration in the tube-axis direction, and the vibration-damping portion is formed of a recessed/projected portion recessed or projected in the tube-axis direction.

According to another aspect of the invention, there is provided a cathode-ray tube apparatus comprising: a substantially rectangular face panel; a funnel made continuous with the face panel; a phosphor screen formed on an inner surface of the face panel; an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage; a deflection yoke which produces deflection magnetic fields that horizontally and vertically deflect the electron beams emitted from the electron gun assembly; an insulating support which extends in a tube-axis direction and supports and fixes the plurality of electrodes of the electron gun assembly; and a plurality of stem pins provided at one end of the neck and electrically connected to the electrodes of the electron gun assembly, wherein the dynamic focus voltage is a voltage obtained by superimposing an AC component varying in synchronism with the deflection magnetic fields upon a reference voltage, each of the dynamic focus electrode and at least one of the electrodes, which is adjacent to the dynamic focus electrode, comprises embedment portions to be embedded in the insulating support, electron beam passage holes that pass the electron beams through, and a vibration-damping portion formed in the surface including the electron beam passage holes to suppress vibration in the tube-axis direction, and the vibration-damping portion is formed of a recessed/projected portion recessed or projected in the tube-axis direction.

According to the cathode-ray tube apparatus, each of the dynamic focus electrode and at least one of the electrodes, which is adjacent to the dynamic focus electrode, comprises embedment portions. Thereby, a flexure phenomenon due to vibration in the tube-axis direction can be suppressed. Specifically, when a dynamic focus voltage is applied, a coulomb force acting between the dynamic focus electrode and the adjacent electrode varies in synchronism with the frequency of the AC component included in the dynamic focus voltage. This results in a tube-axis-directional mechanical vibration of each electrode and a flexure vibration of the electrodes. However, these vibrations can be suppressed.

As is shown in FIG. 17, the plate-shaped dynamic focus electrode (G3-1) has the recessed/projected vibration-damping portion (X3) in the surface including the electron beam passage hole (X2). When the vibration-damping portion is not provided, the coulomb force acts mainly at an intermediate portion, i.e. the electron beam passage hole, between the upper and lower support fixture points. By contrast, with the vibration-damping portion provided, the coulomb force acts mainly at the recessed/projected vibration-damping portion. At the same time, the coulomb force acting on the whole electrode is dispersed by the vibration-damping portion, and a flexure phenomenon does not easily occur.

Thereby, a resonance phenomenon due to the frequency component in the AC component and the natural vibration characteristics of the electrode can be suppressed. Accordingly, the frequency modulation of mechanical vibration caused by the electrode due to coulomb force variations and the increase in the tube-axis-directional vibration amplitude can be suppressed. Therefore, the occurrence of mechanical vibration transmitted to the funnel via the insulating support and stem pins can be reduced, and the occurrence of abnormal noise suppressed. Thus, a CRT apparatus with high product values and reliability can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 10 is a cross-sectional view schematically showing the structure of the color CRT apparatus according to the embodiment of the invention;

FIG. 11 is a view illustrating the state in which an electron beam suffers a deflection aberration;

FIG. 12 is a view illustrating deformation of a beam spot;

DETAILED DESCRIPTION OF THE INVENTION

A cathode-ray tube apparatus according to an embodiment of the present invention will now be described with reference to the accompanying drawings.

Figure 1:
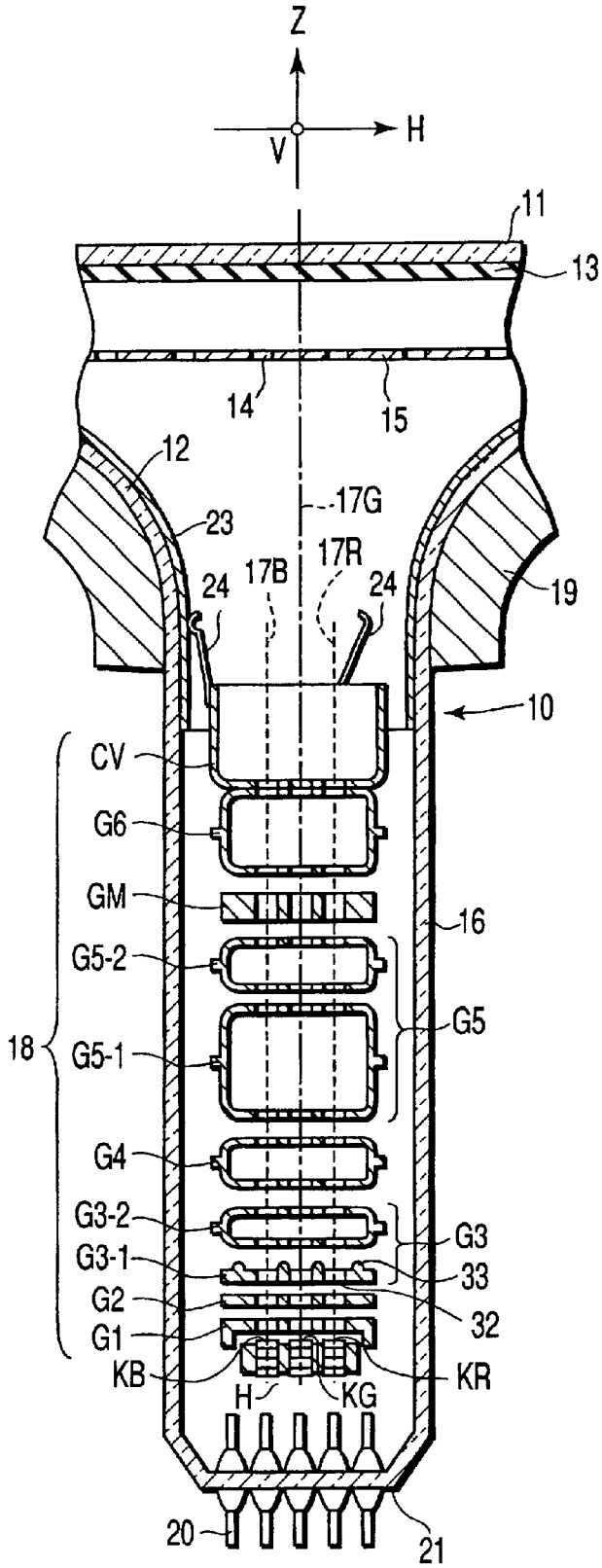
FIG. 1 is a partial cross-sectional view schematically showing the structure of a color CRT apparatus according to an embodiment of the present invention.

As is shown in FIGS. 1 and 10, a cathode-ray tube (CRT) apparatus has an envelope 10. This CRT apparatus is a self-convergence type color CRT apparatus used in a color TV receiver, a color terminal display, etc. The envelope 10 has a substantially rectangular face panel 11, and a funnel 12 integrally coupled to the face panel 11. A phosphor screen 13 is formed on an inside surface of the face panel 11 and comprises striped or dot-shaped three-color phosphor layers that emit blue, green and red light, respectively. A shadow mask 15 is disposed to face the phosphor screen 13 and has many apertures 14 in its inner area. The shadow mask 15 is attached to a mask frame 41. The mask frame 41 is engaged with stud pins 44 via resilient support members 42. The stud pins 44 are provided on an inner surface of a skirt portion 43 of the face panel 11. An inner shield 45 is attached to the mask frame 41. An explosion-proof band 46 and lug portions 47 for attachment to the housing (not shown) are provided on an outer peripheral part of the skirt portion 43.

An in-line electron gun assembly 18 is disposed within a neck 16 corresponding to a small-diameter portion of the funnel 12. The electron gun assembly 18 emits three horizontal in-line electron beams 17B, 17G and 17R, i.e. a center beam 17G and a pair of side beams 17B and 17R, toward the phosphor screen 13. In the electron gun assembly 18, side beam passage holes in the low-voltage side electrode of a main lens section are decentered relative to those in the high-voltage side electrode of the main lens section. Thereby, the three electron beams 17B, 17G and 17R are converged on a central area of the phosphor screen 13.

An end portion of the neck 16 is sealed by a stem portion 21. A plurality of stem pins 20 are embedded in the stem portion 21. The stem pins 20 are electrically connected to the electrodes of the electron gun assembly 18 and supplied with predetermined voltages.

A deflection yoke 19 is mounted on an outside part of the funnel 12. The deflection yoke 19 produces non-uniform magnetic fields that deflect the three electron beams 17B, 17G and 17R emitted from the electron gun assembly 18 in a horizontal direction H and a vertical direction V. The non-uniform magnetic fields comprise a pincushion-shaped horizontal deflection magnetic field and a barrel-shaped vertical deflection magnetic field.

In this type of color CRT apparatus, the three electron beams 17B, 17G and 17R emitted from the electron gun assembly 18 are focused on the associated phosphor layers on the phosphor screen 13, while being self-converged toward the phosphor screen 13. In addition, the three electron beams 17B, 17G and 17R are deflected by the non-uniform deflection magnetic fields to scan the phosphor screen 13 in the horizontal direction H and vertical direction V. Thus, a color image is displayed.

Figure 2:
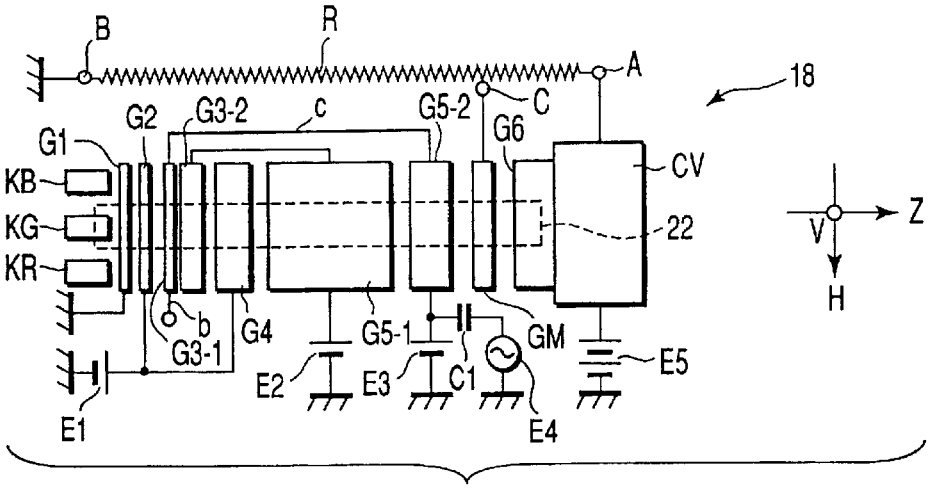
FIG. 2 is a view schematically showing the structure of an example of an electron gun assembly applied to the color CRT apparatus shown in FIG. 1.

The electron gun assembly 18 applied to the color CRT apparatus is constructed, as shown in FIGS. 1 and 2. The electron gun assembly 18 includes cathodes KB, KG and KR each accommodating a heater. The cathodes KB, KG and KR are arranged in line in the horizontal direction H perpendicular to a tube-axis direction Z at intervals of about 5 mm. The electron gun assembly 18 includes first to sixth grids successively arranged in the tube-axis direction Z from the cathode K side toward the phosphor screen 13. The third grid G3 comprises a first segment G3-1 disposed on the cathode K side and a second segment G3-2 disposed on the phosphor screen 13 side. The fifth grid G5 comprises a first segment G5-1 disposed on the cathode K side and a second segment G5-2 disposed on the phosphor screen 13 side. An intermediate electrode GM is disposed between the second segment G5-2 of fifth grid G5 and the sixth grid G6. A convergence cup CV is fixed to the sixth grid G6 by means of welding.

The first grid G1 and second grid G2 are arranged at a very small distance of 0.2 mm or less. The second grid G2 and the first segment G3-1 of third grid G3 are arranged at a distance of about 0.5 to 1 mm. The first segment G3-1 and second segment G3-2 are arranged at a distance of about 0.2 to 0.8 mm. The second segment G3-2 and fourth grid G4 are arranged at a distance of about 0.5 to 1 mm. The fourth grid G4, the first segment G5-1 of fifth grid G5, the second segment G5-2 of fifth grid G5, the intermediate electrode GM, and the sixth grid G6 are arranged at distances of about 0.5 to 1 mm, respectively.

These electrodes are fixed by a pair of insulating supports 22 formed of bead glass. A plurality of contacts 24 provided on the convergence cup CV are electrically connected to an internal conductor film 23 coated on an area extending from the inner surface of the funnel 12 to the inner surface of the neck 16. A lead line b for supplying voltage to the first segment G3-1 of third grid G3 and a lead line c for connecting the first segment G3-1 and the segment G5-2 of fifth grid G5 are connected at diagonal positions of the first segment G3-1.

Each of the electrodes has three electron beam passage holes for passing the three electron beams 17B, 17G and 17R in association with the cathodes KB, KG and KR. Each of the first grid G1 and second grid G2 is a plate-shaped electrode and has small electron beam passage holes each having a diameter of 0.5 mm or less. The first segment G3-1 is a plate-shaped electrode and has electron beam passage holes each having a diameter of about 1 mm. The second segment G3-2 has, in its surface facing the first segment G3-1, oval electron beam passage holes each having a vertical dimension of about 1 mm and a horizontal dimension of about 3–6 mm. Each of that surface of the second segment G3-2, which faces the fourth grid G4, the fourth grid G4, the first segment G5-1, the second segment G5-2, the intermediate electrode GM, and the sixth grid G6 has relatively large electron beam passage holes each having a diameter of about 3–6 mm.

Electron lenses are created between the electrodes by making the electron beam passage holes of the respective electrodes face each other at predetermined distances. Specifically, the cathodes K, first grid G1 and second grid G2 constitute an electron beam generating section that generates electron beams. The first segment G5-1 of fifth grid G5, the second segment G5-2 of fifth grid G5, the intermediate electrode GM and the sixth grid G6 constitute a main lens section for ultimately focusing the electron beams on the phosphor screen 13.

Quadrupole lenses are created between the first segment G3-1 and second segment G3-2 of the third grid and between the first segment G5-1 and second segment G5-2 of the fifth grid by combining circular, vertically elongated and horizontally elongated electron beam passage holes formed in their mutually opposing surfaces, or by providing screens around their asymmetric electron beam passage holes.

Figure 3:
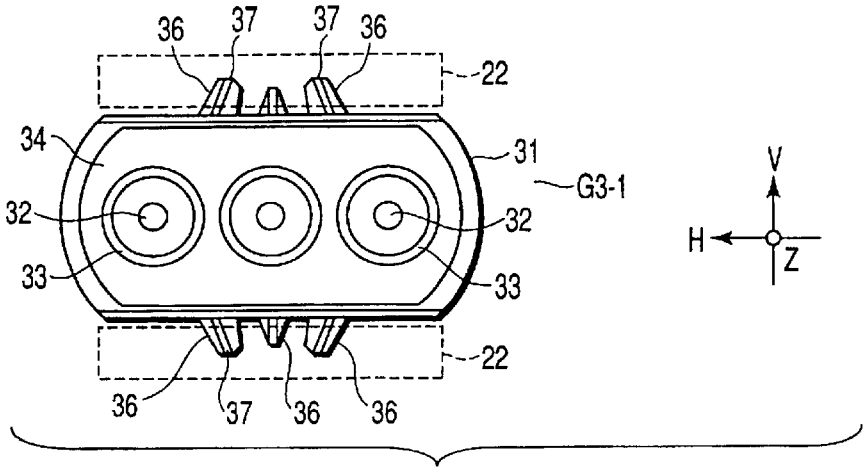
FIG. 3 is a front view schematically showing the structure of a first segment of a third grid applied to the electron gun assembly shown in FIG. 2.
Figure 4:
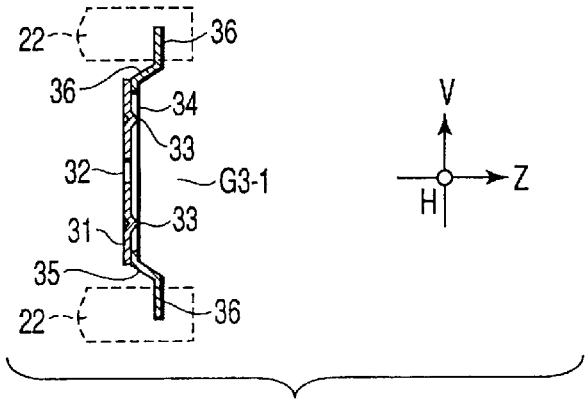
FIG. 4 is a cross-sectional view schematically showing the structure of the first segment shown in FIG. 3.

The first segment G3-1 of the third grid is constructed, for example, as shown in FIGS. 3 and 4. The first segment G3-1 has a flat electrode plate 31. The electrode plate 31 has a rectangular shape elongated in the horizontal direction H. The electrode plate 31 has three electron beam passage holes 32 provided in association with the three electron beams arranged in the horizontal direction H.

The electrode plate 31 has vibration-damping portions 33 formed to damp vibration in the tube-axis direction Z. Each vibration-damping portion 33 is a recessed/projected portion that is recessed or projected in the tube-axis direction Z. In this embodiment, the vibration-damping portion 33 is an annular recess or projection formed around each electron beam passage hole 32. The vibration-damping portion 33 is formed by means of drawing, or a so-called beading process.

The first segment G3-1 also has a vibration-damping portion 34. The vibration-damping portion 34 is a recessed portion formed by recessing the entire electrode plate 31 including the vibration-damping portions 33 toward the second grid G2 side. The vibration-damping portion 34 is formed by a beading process.

The first segment G3-1 has embedment portions 36 extending in the vertical direction V. The embedment portions 36 are formed in parallel to the electrode plate 31 with electron beam passage holes 32, and are displaced relative to the electrode plate 31 in the tube-axis direction Z. The electrode plate 31 and embedment portions 36 are integrally coupled by oblique portions 35.

Each embedment portion 36 has a reinforcement portion 37 for reinforcing fixation to the insulating support 22. The reinforcement portion 37 is formed by a recessed or projecting portion extending in the longitudinal direction of the embedment portion 36. The reinforcement portion 37 is formed by a beading process. Alternatively, the reinforcement portion 37 may be formed by subjecting to a beading process the entire embedment portion 36 excluding an outer peripheral portion thereof.

Thereby, the flexure rigidity of the first segment G3-1 to vibration in the tube-axis direction Z can be enhanced, and mechanical vibration in the tube-axis direction Z can be suppressed. Specifically, the vibration-damping portions (recessed/projected portions) 33 formed symmetric with respect to the electron beam passage holes 32 of first segment G3-1 can enhance the flexure rigidity of the electrode itself in the state in which the first segment G3-1 is supported by the embedment portions 36 embedded in the insulating supports 22. In addition, the action of the coulomb force due to a varying dynamic focus voltage applied to the first segment G3-1 concentrates mainly at the vibration-damping portions (recessed/projected portions) 33 which are located closest to the adjacent electrode. Accordingly, the coulomb force does not act at the center of the electrode and is dispersed to the vibration-damping portions 33. The variation in coulomb force does not convert to flexure of the electrode in the state in which the electrode is supported by the embedment portions 36. Thereby, it is possible to suppress a frequency modulation and an increase in mechanical vibration amplitude due to a resonance between the natural vibration characteristics of the electrode in tube-axis direction Z and the frequency component in the dynamic focus voltage. Therefore, occurrence of abnormal noise via the funnel can effectively be suppressed.

In addition, by the beading process for forming the vibration-damping portion 34, the electron beam passage holes 32 in the electrode plate 31 of first segment G3-1 can be made closer to the second segment G3-2. This increases the lens intensity of the quadrupole lens created between the first segment G3-1 and second segment G3-2. Moreover, if the other part of the electrode plate 31 is made away from the second segment G3-2, the coulomb force between the electrodes can be decreased.

Within the neck 16 of the above-described CRT apparatus, a resistor R is provided to extend in the tube-axis direction Z. As is shown in FIG. 2, the resistor R is provided, for example, on that surface of the insulating support 22, which is opposite to the surface provided with the electrodes. One end A of the resistor R is connected to the convergence cup CV, and the other end B thereof is led out of the tube and grounded. An intermediate point C of resistor R is electrically connected to the intermediate electrode GM.

In the electron gun assembly 18 with the above structure, the three cathodes KB, KG and KR are supplied with a voltage of about 100 to 150 V. The first grid G1 is grounded. The second grid G2 and fourth grid G4 are connected within the tube and supplied with a voltage of about 600 to 800 V from a power supply E1.

The first segment G3-1 of third grid G3 and the second segment G5-2 of the fifth grid are connected within the tube. These electrodes are supplied with a dynamic focus voltage obtained by superimposing an AC component supplied from an AC power via a capacitor C1 upon a focus voltage (reference voltage) of about 6–9 kV supplied from a power supply E3. This AC component varies in synchronism with the deflection magnetic fields.

The second segment G3-2 of the third grid and the first segment G5-1 of the fifth grid are connected within the tube. These electrodes are supplied with a focus voltage of about 6–9 kV from a power supply E2. The sixth grid G6 is supplied with an anode voltage of about 25–30 kV from a power supply E5. The intermediate electrode GM is supplied with a voltage from the intermediate point C of resistor R, which voltage is about 50% to 70% of the anode voltage supplied to the sixth grid G6.

In the above structure, a first quadrupole lens section is created by the first segment G3-1 and second segment G3-2 of the third grid G3. The first quadrupole lens section controls the incidence angles of the three electron beams 17B, 17G and 17R, which enter the main lens section comprising the electrodes from the first segment G5-1 of fifth grid G5 to the sixth grid G6, in synchronism with the deflection magnetic fields. At the same time, a second quadrupole lens section is created by the first segment G5-1 and second segment G5-2 of fifth grid G5. The second quadrupole lens section can alter its own lens action in synchronism with the deflection magnetic fields by the application of the dynamic focus voltage. Thus, the horizontal deformation of the beam spot can be improved, compared to the electron gun assembly supplied with no dynamic focus voltage. Moreover, the three electron beams 17B, 17G and 17R can be appropriately focused on a peripheral portion of the phosphor screen 13. Therefore, a moire, etc. can be suppressed at a peripheral portion of the screen, and good focus characteristics can be obtained over the entire screen.

The first segment G3-1 of third grid G3 is provided with vibration-damping portions 33 and 34 formed by applying a beading process to a peripheral portion of each electron beam passage hole 32 and an outer peripheral portion of the electrode plate 31. Thus, the flexure rigidity of the first segment G3-1 can be increased, and the flexure vibration in the tube-axis direction Z can greatly be suppressed. Accordingly, the amplitude of vibration propagated to the funnel 12 is remarkably suppressed, and the amplitude of vibration of the funnel 12 decreased to an negligible level. As a result, occurrence of abnormal noise can be prevented.

Compared to an electrode body provided with no vibration-damping portions formed by a beading process, the electrode body G3-1 with the above structure can have sufficient vibration-suppressing effect and support strength when embedded in the insulating support, even if the thickness of the electrode plate 31 is decreased about 20% to about 0.4 mm to 0.32 mm. It is thus possible to similarly decrease the thickness of the embedment portion 36 of electrode body G3-1. By decreasing the thickness of the embedment portion 36, the embedment portion 36 is well supported and fixed in the insulating support 22. Thus, the support strength of the embedment portion 36 in the insulating support 22 can be increased. The reinforcement portion 37, which is provided on the embedment portion 36, further increases the support strength of the electrode body. Moreover, since the weight of the electrode is decreased, the moment of vibration due to coulomb force can be decreased. As a result, abnormal noise can effectively be suppressed.

Figure 5:
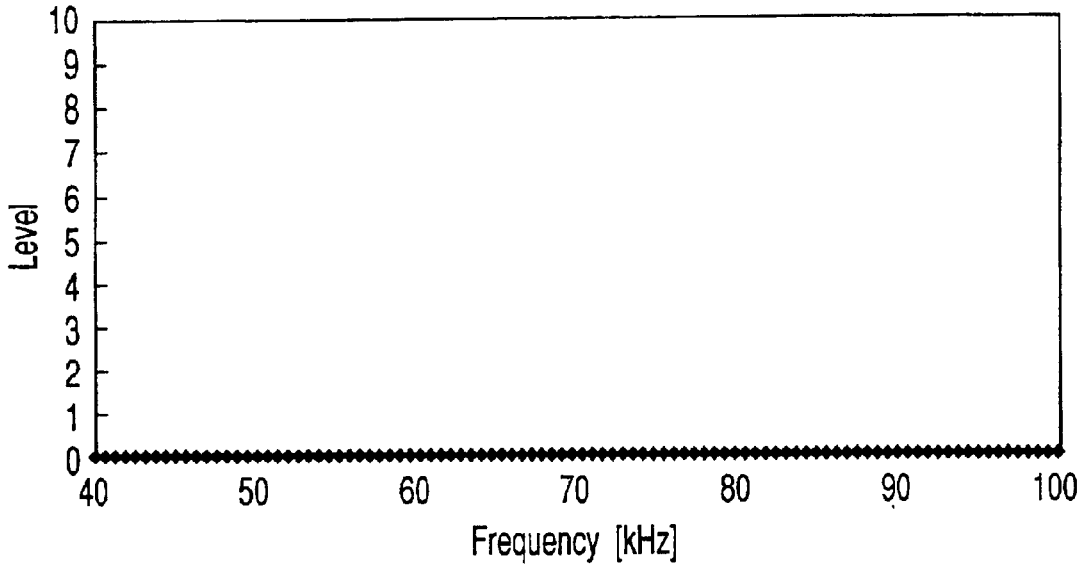
FIG. 5 is a graph showing measured results of abnormal noise produced from the color CRT apparatus according to the embodiment.
Figure 6:
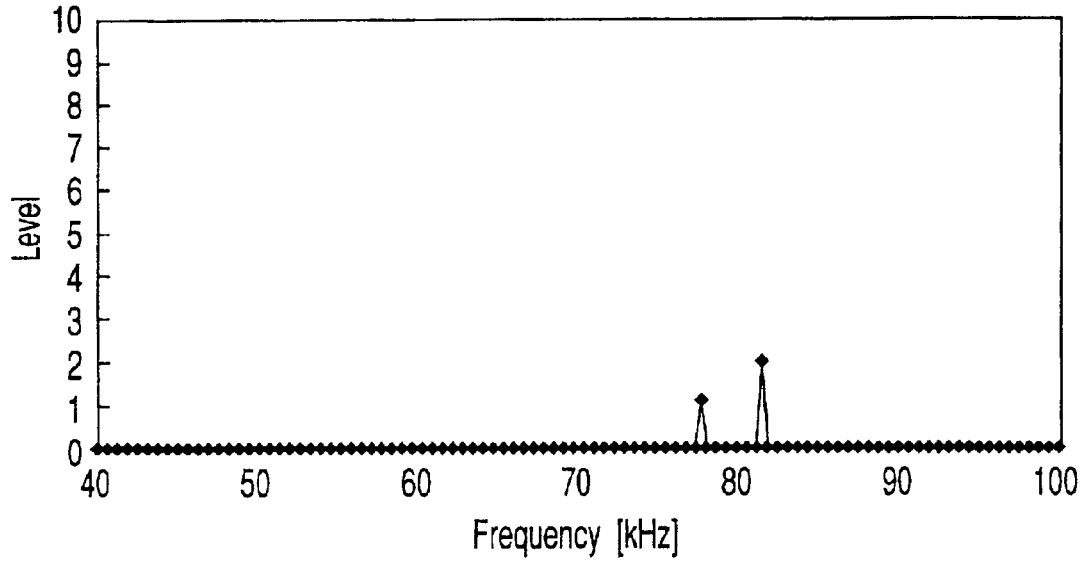
FIG. 6 is a graph showing measured results of abnormal noise produced from a color CRT apparatus according to another embodiment of the invention.

Using the CRT apparatus with the above-described electron gun assembly 18, abnormal noise was measured by the same method as in the prior art. In this case, the first segment G3-1 of third grid G3 and the second segment G5-2 of fifth grid G5 of the electron gun assembly 18 were supplied with a dynamic focus voltage including an AC component of 40–100 kHz. FIGS. 5 and 6 show the measured results. The abscissa indicates the frequency of the AC component included in the dynamic focus voltage, and the ordinate indicates the level of sound pressure sensed by humans in 10 grades. According to the measured results, as shown in FIG. 5, no abnormal noise, which occurred in the prior art, was recognized in all frequency bands. As regards other manufacture lots, as shown in FIG. 6, abnormal noise occurred very rarely in specific frequency bands, but the sound pressure level was not higher than 2. No practical problem was posed. According to the CRT apparatus with the above structure, abnormal noise can remarkably be suppressed.

Figure 7:
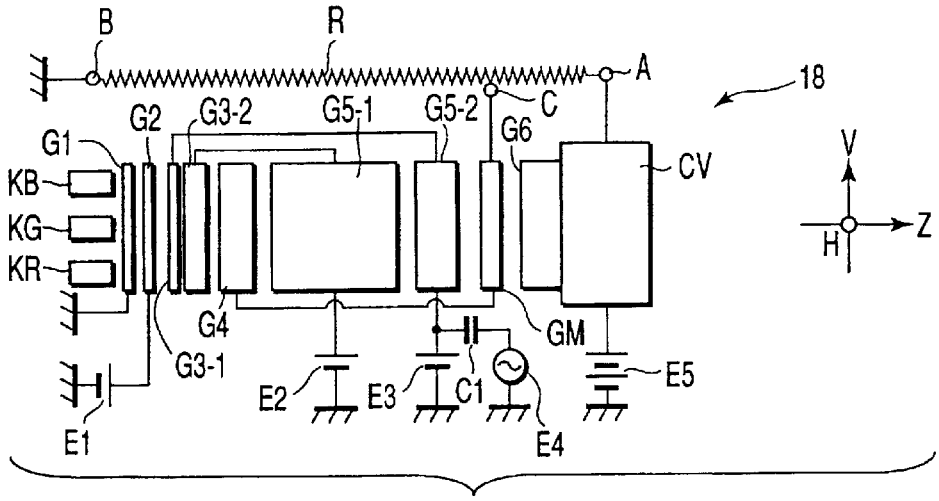
FIG. 7 is a view schematically showing the structure of another electron gun assembly applicable to the color CRT apparatus shown in FIG. 1.

The above-described embodiment is directed to the electron gun assembly 18 as shown in FIG. 2 by way of example. The present invention is not limited to this structure. The electrode structures and the voltages applied to the electron gun assembly 18 may be variously modified. For example, the electron gun assembly 18 may be constructed, as shown in FIG. 7. In the electron gun assembly 18 shown in FIG. 7, the fourth grid G4 and intermediate electrode GM are connected, and the voltage applied to the intermediate electrode GM is also applied to the fourth grid G4. This electron gun assembly 18, too, can operate like the electron gun assembly shown in FIG. 2, and can have the same advantages.

Figure 8:
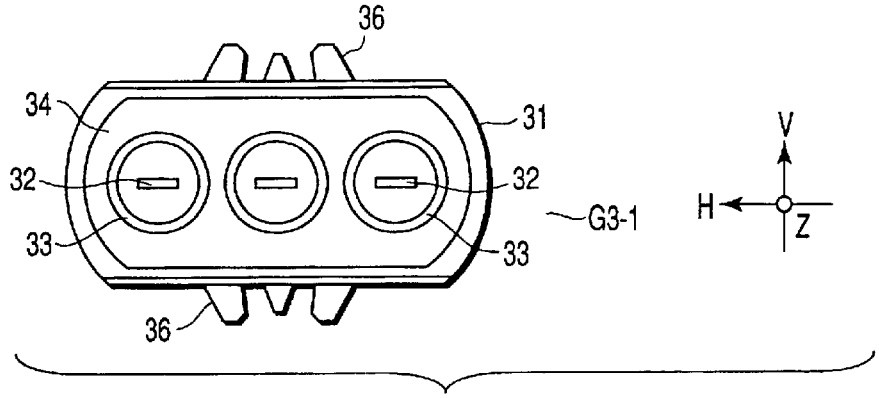
FIG. 8 is a front view schematically showing another structure of the first segment of the third grid.

On the other hand, the first segment G3-1 of third grid G3 may be constructed, as shown in FIG. 8. The electron beam passage hole 32 formed in the electrode plate 31 may not be a circular hole, but a slit elongated in the horizontal direction H. With this structure, too, the occurrence of abnormal noise can effectively be suppressed by the vibration-damping portions 33 and 34. Of course, the electron beam passage hole may have some other shape, e.g. a vertical elongated shape.

In the above-described embodiment, the vibration-damping portion 33 is an annular recessed/projected portion formed around the electron beam passage hole 32. The structure of the vibration-damping portion 33 is not limited to this. For example, the same advantage can be obtained even if the individually formed recessed/projected portion is disposed symmetric with respect to the electron beam passage hole.

The first segment G3-1 may have other structures, as shown in FIGS. 18A to 18E. With these structures wherein vibration-damping portions 33 are formed with the electron beam passage holes 32 interposed, the flexure rigidity can further be enhanced.

The vibration-damping portions 33 and 34 and reinforcement portions 37 may be provided on another electrode supplied with a dynamic focus voltage, e.g. the second segment G5-2 of fifth grid G5. The kind and number of electrodes to be provided with vibration-damping portions 33 and 34 and reinforcement portions 37 by the beading process are not limited. The structures of the vibration-damping portion 33, 34 and the structures of the reinforcement portions 37 may be uniform or combinations of various structures. Needless to say, these structures may be modified where necessary.

Figure 9:
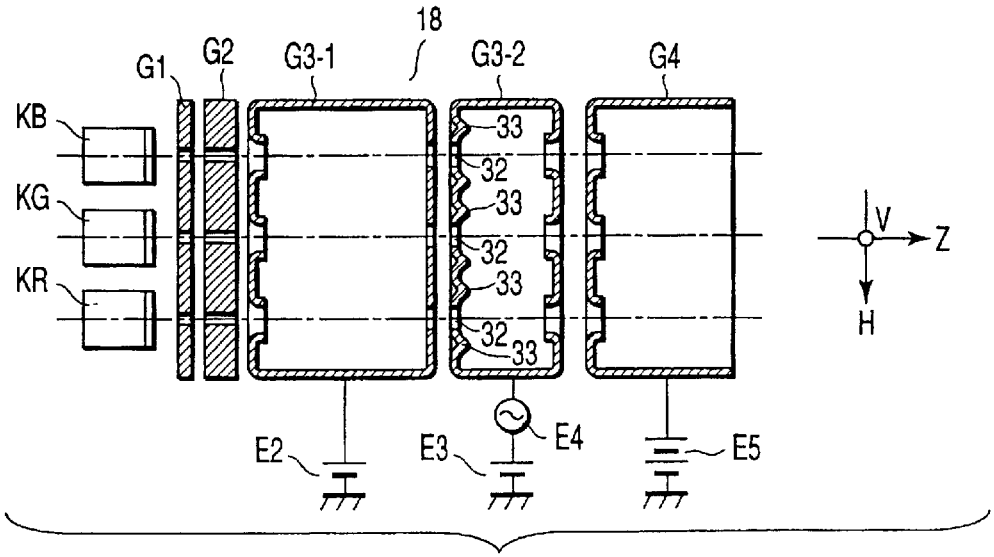
FIG. 9 is a view schematically showing the structure of another electron gun assembly applicable to the color CRT apparatus shown in FIG. 1.
Figure 13:
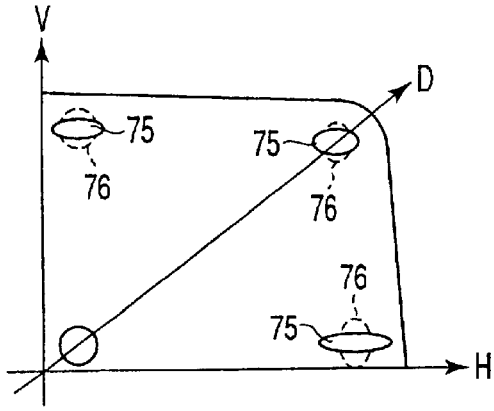
FIG. 13 is a view illustrating deformation of a beam spot on a screen.
Figure 14:
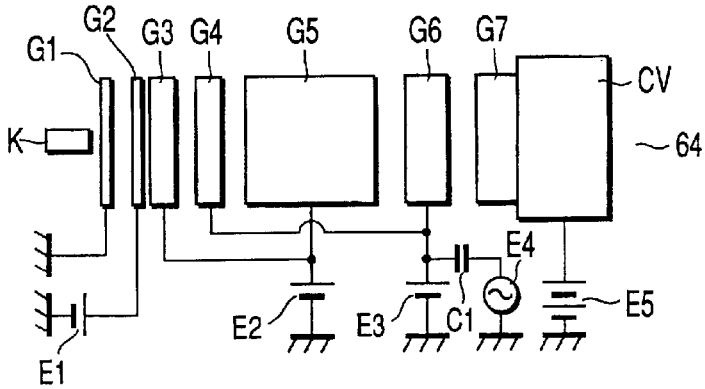
FIG. 14 shows an example of a prior-art electron gun assembly.
Figure 15:
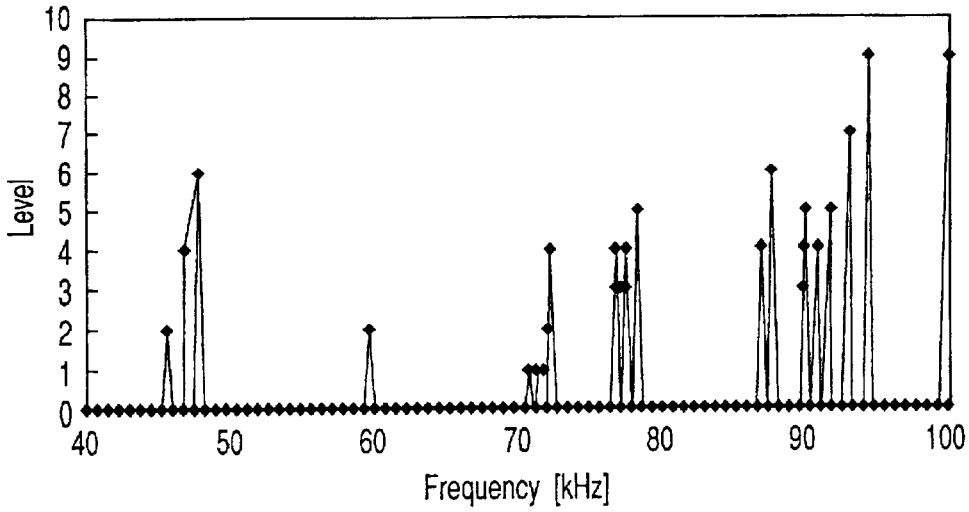
FIG. 15 is a graph showing measured results of abnormal noise produced from the prior-art color CRT apparatus.
Figure 16:
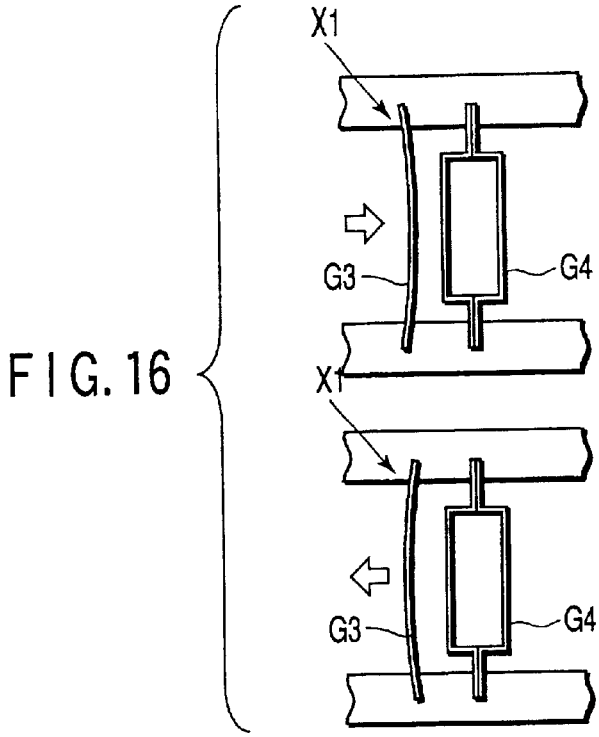
FIG. 16 is a view illustrating a flexure phenomenon due to coulomb force of a dynamic focus electrode.
Figure 17:
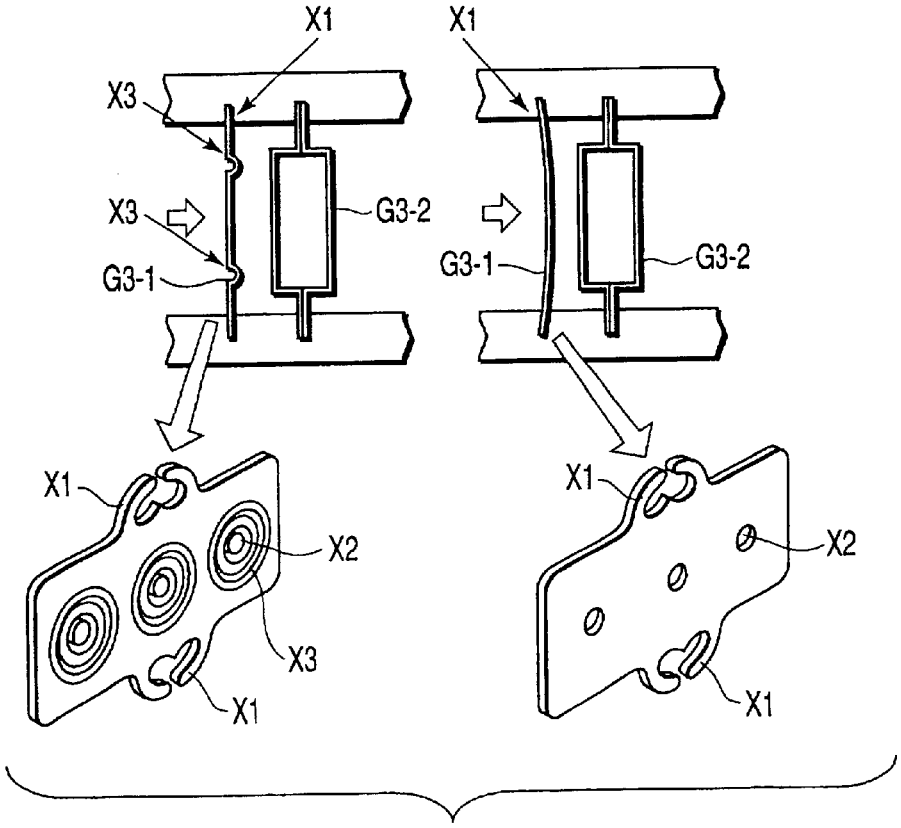
FIG. 17 is a view for explaining the advantage of the color CRT apparatus of the present invention.
Figure 18A:
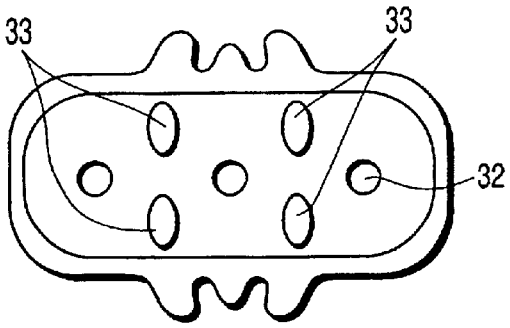
FIGS. 18A to 18E are front views schematically showing other structures of the first segment of the third grid.
Figure 18D:
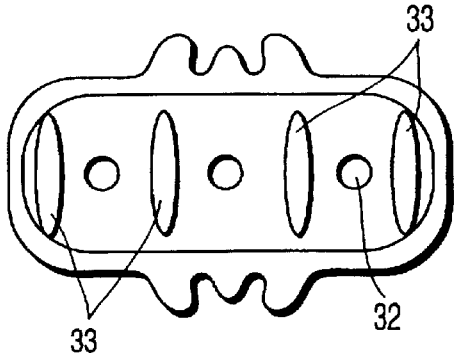
Figure 18B:
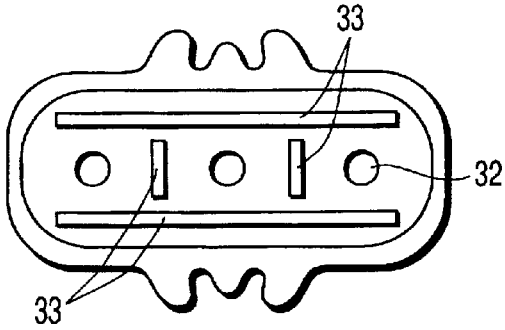
Figure 18E:
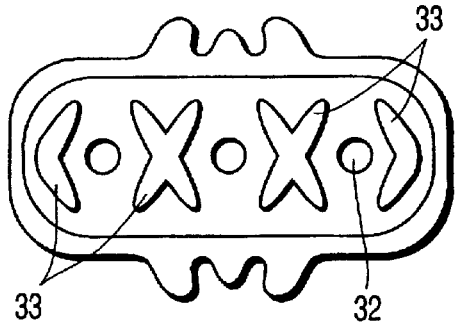
Figure 18C:
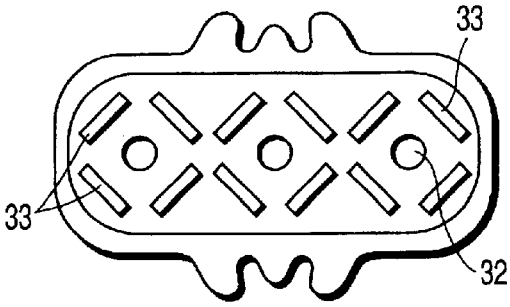

The present invention is also applicable to an electron gun assembly 18, as shown in FIG. 9, which adopts a bipotential-focus-type dynamic focus method. In this electron gun assembly 18, a first grid electrode G1, a second grid electrode G2, a first segment G3-1 and a second segment G3-2 of a third grid, and a fourth grid G4 are arranged on the same axis at predetermined distances from three cathodes KB, KG and KR. For example, a voltage of about 150 V is applied to the cathodes KB, KG and KR. The first grid G1 is grounded. A voltage of about 600 V is applied to the second grid G2. The first segment G3-1 is supplied with a voltage of about 8 kV, and the second segment G3-2 is supplied with a dynamic focus voltage of about 8 kV. An anode voltage of about 26 kV is applied to the fourth grid electrode G4. The dynamic focus voltage is a parabolic voltage varying in accordance with the deflection operations so as to take a maximum value when the three electron beams 17B, 17G and 17R are deflected onto a peripheral area of the phosphor screen 13 by the deflection magnetic fields.

In this electron gun assembly 18, the cathodes KB, KG and KR, first grid G1 and second grid G2 constitute an electron beam generating section. The second grid G2 and the first segment G3-1 constitute a pre-focus lens section. The second segment G3-2 and fourth grid G4 constitute a bipotential type main lens section, and focus the three electron beams 17B, 17G and 17R on the phosphor screen 13.

The potential difference between the second segment G3-2 and fourth grid G4 takes a minimum value when the electron beams 17B, 17G and 17R are deflected on the peripheral area of the phosphor screen 13. Accordingly, in this case, the lens intensity of the main lens section takes a minimum value. At the same time, the lens intensity of a quadrupole lens constituted by the first segment G3-1 and second segment G3-2 takes a maximum value.

The quadrupole lens is designed to focus the electron beams in the horizontal direction H and to diverge them in the vertical direction V. Thereby, when the electron beams are deflected on the peripheral portion of the phosphor screen 13, the lens intensity of the main lens section is decreased. Thus, the movement of the focal point is compensated as the distance between the electron gun assembly 18 and phosphor screen 13 increases and the image point moves farther. At the same time, with the formation of the quadrupole lens section, a deflection aberration due to the deflection magnetic fields is compensated.

In the electron gun assembly 18 with the above structure, the second segment G3-2 supplied with the dynamic focus voltage is formed of a cup-shaped electrode. Compared to the above-described case where the second segment G3-2 is formed of a plate-shaped electrode, vibration due to coulomb force can be lessened. However, if annular vibration-damping portions 33 are formed by a beading process, for example, around the electron beam passage holes 32, the flexure rigidity of the electrode can be enhanced and abnormal noise can be prevented more effectively.

As has been described above, according to the CRT apparatus of this invention, even if the electrode to which the dynamic focus voltage is applied is located near the heaters, or the heat sources, in the cathodes (i.e. even if the first quadrupole lens is situated near the cathodes in order to improve horizontal deformation of the beam spot on the peripheral area of the screen), it is possible to suppress vibration of the electrode in the tube-axis direction resulting from a variation in potential difference between the electrodes due to the application of the dynamic focus voltage. Moreover, it is possible to suppress a resonance phenomenon due to the frequency characteristics of the AC component in the dynamic focus voltage and the natural vibration characteristics (characteristic frequency) of the electrode supplied with the dynamic focus voltage. Thus, the frequency modulation and the increase in amplitude can be suppressed to a substantially negligible level. Therefore, the occurrence of abnormal noise at the funnel due to propagation of vibration from the electrode can be suppressed. At the same time, since the first quadrupole lens can be situated near the heat source, horizontal deformation of the beam spot at the peripheral portion of the screen can effectively be improved. The industrial advantages of these features are very great.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

a substantially rectangular face panel;

a funnel made continuous with the face panel;

a phosphor screen formed on an inner surface of the face panel;

an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage;

a deflection yoke which produces deflection magnetic fields that horizontally and vertically deflect the electron beams emitted from the electron gun assembly;

an insulating support which extends in a tube-axis direction and supports and fixes the plurality of electrodes of the electron gun assembly; and a plurality of stem pins provided at one end of the neck and electrically connected to the electrodes of the electron gun assembly, wherein said dynamic focus voltage is a voltage obtained by superimposing an AC component varying in synchronism with the deflection magnetic fields upon a reference voltage, said dynamic focus electrode comprises embedment portions to be embedded in the insulating support, electron beam passage holes that pass the electron beams through, and a vibration-damping portion formed in the surface including the electron beam passage holes to suppress vibration in the tube-axis direction, and said vibration-damping portion is formed of a recessed/projected portion recessed or projected in the tube-axis direction.

2. A cathode-ray tube apparatus according to claim 1, wherein said dynamic focus electrode comprises a plate-shaped electrode.

3. A cathode-ray tube apparatus according to claim 1, wherein said vibration-damping portion comprises an annular recessed or projected portion formed around the electron beam passage hole.

4. A cathode-ray tube apparatus according to claim 1, wherein said vibration-damping portion is formed by recessing an entire plate face in which said electron beam passage holes are made.

5. A cathode-ray tube apparatus according to claim 1, wherein each of said embedment portions comprises a recessed/projected portion that is recessed or projected in the tube-axis direction.

6. A cathode-ray tube apparatus according to claim 1, wherein said dynamic focus electrode is formed such that a plate face thereof, in which the electron beam passage holes are made, and the embedment portions, which are continuous with the place face, are arranged in parallel in a direction perpendicular to the tube-axis direction and are displaced from each other in the direction perpendicular to the tube-axis direction.

7. A cathode-ray tube apparatus comprising:

a substantially rectangular face panel;

a funnel made continuous with the face panel;

a phosphor screen formed on an inner surface of the face panel;

an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage;

a deflection yoke which produces deflection magnetic fields that horizontally and vertically deflect the electron beams emitted from the electron gun assembly;

an insulating support which extends in a tube-axis direction and supports and fixes the plurality of electrodes of the electron gun assembly; and a plurality of stem pins provided at one end of the neck and electrically connected to the electrodes of the electron gun assembly, wherein said dynamic focus voltage is a voltage obtained by superimposing an AC component varying in synchronism with the deflection magnetic fields upon a reference voltage, at least one of the electrodes, which is adjacent to said dynamic focus electrode, comprises embedment portions to be embedded in the insulating support, electron beam passage holes that pass the electron beams through, and a vibration-damping portion formed in the surface including the electron beam passage holes to suppress vibration in the tube-axis direction, and said vibration-damping portion is formed of a recessed/projected portion recessed or projected in the tube-axis direction.

8. A cathode-ray tube apparatus comprising:

a substantially rectangular face panel;

a funnel made continuous with the face panel;

a phosphor screen formed on an inner surface of the face panel;

an electron gun assembly disposed within a neck of the funnel and including an electron beam generating section that generates electron beams, and a main lens section that focuses the electron beams on the phosphor screen, the electron gun assembly having a plurality of electrodes including a dynamic focus electrode to be supplied with a dynamic focus voltage;

a deflection yoke which produces deflection magnetic fields that horizontally and vertically deflect the electron beams emitted from the electron gun assembly;

an insulating support which extends in a tube-axis direction and supports and fixes the plurality of electrodes of the electron gun assembly; and a plurality of stem pins provided at one end of the neck and electrically connected to the electrodes of the electron gun assembly, wherein said dynamic focus voltage is a voltage obtained by superimposing an AC component varying in synchronism with the deflection magnetic fields upon a reference voltage, each of said dynamic focus electrode and at least one of the electrodes, which is adjacent to said dynamic focus electrode, comprises embedment portions to be embedded in the insulating support, electron beam passage holes that pass the electron beams through, and a vibration-damping portion formed in the surface including the electron beam passage holes to suppress vibration in the tube-axis direction, and said vibration-damping portion is formed of a recessed/projected portion recessed or projected in the tube-axis direction.

* * * * *